US005552739A

United States Patent [19]

Keeth et al.

[11] Patent Number: 5,552,739

[45] Date of Patent: Sep. 3, 1996

[54] INTEGRATED CIRCUIT POWER SUPPLY HAVING PIECEWISE LINEARITY

[75] Inventors: Brent Keeth; Paul S. Zagar; Brian M. Shirley; Stephen L. Casper, all of Boise, Id.

[73] Assignee: Micron Technology, Inc., Boise, Id.

[21] Appl. No.: 559,414

[22] Filed: Nov. 15, 1995

Related U.S. Application Data

[63] Continuation of Ser. No. 194,184, Feb. 8, 1994, abandoned.

[51] Int. Cl.[6] ..... G05F 1/10

[52] U.S. Cl. ..... 327/538; 327/530; 327/561; 327/312

[58] Field of Search ..... 327/310, 314, 327/325, 535, 546, 538, 545, 540, 530, 404, 434, 541, 312, 561, 562, 563

[56] References Cited

U.S. PATENT DOCUMENTS

| | | | |
|---|---|---|---|
| 4,300,065 | 11/1981 | Remedi et al. | 327/543 |
| 4,853,563 | 8/1989 | Hill et al. | 327/434 |
| 5,289,425 | 2/1994 | Horiguchi et al. | 327/540 |
| 5,349,290 | 9/1994 | Yamada | 328/158.1 |
| 5,384,739 | 1/1995 | Keeth | 327/540 |
| 5,426,616 | 6/1995 | Kajigaya et al. | 365/226 |
| 5,434,533 | 7/1995 | Furutani | 327/538 |

OTHER PUBLICATIONS

Masashi Horiguchi, "Dual–Regulator Dual–Decoding–Trimmer DRAM Voltage Limiter for Burn–in Test", *IEEE Journal of Solid–State Circuits*, vol. 26, No. 11, Nov. 1991, pp. 1544–1549.

R. S. Mao, "A New On–chip Voltage Regulator for High Density CMOS DRAMs", *Symposium on VLSI Circuits Digest of Technical Papers*, 1992 IEEE, pp. 108–109.

H. Tanaka, "Sub–1–μA Dynamic Reference Voltage Generator for Battery–Operated DRAMs", *Symposium On VLSI Circuits Digest of Technical Papers*, 1993 IEEE, pp. 87–88.

Masashi Horiguchi, "Dual–Operating–Voltage Scheme for a Single 5–V 16–Mbit DRAM", *IEEE Journal of Solid–State Circuits*, vol. 23, No. 5, Oct. 1988, pp. 1128–1132.

*Primary Examiner*—Timothy P. Callahan
*Assistant Examiner*—Jung Ho Kim
*Attorney, Agent, or Firm*—Schwegman, Lundberg, Woessner & Kluth, P.A.

[57] ABSTRACT

A power supply for an integrated circuit has a piecewise linear operating characteristic for improved integrated circuit testing and screening. In an integrated circuit that receives an externally applied power signal, designated $V_{CCX}$, and includes a power supply for generating an internal operating voltage, designated $V_{CCR}$, an on-chip power supply circuit provides $V_{CCR}$ as a piecewise linear function of $V_{CCX}$. In a first segment of such a function, $V_{CCR}$ approximates $V_{CCX}$ for efficient low voltage operations. In a second segment, used for normal operations of the integrated circuit, $V_{CCR}$ rises gradually with $V_{CCX}$ so that test results at the edges of the segment can be guaranteed with a margin for measurement tolerance, process variation, and derating. In a third segment, $V_{CCR}$ follows below $V_{CCX}$ at a predetermined constant offset. Transitions between segments are smooth due to nonlinear devices used in the power supply circuitry. When used in a dynamic random access memory integrated circuit, operation in the first segment provides data retention at low power consumption. Operation in the second segment supports speed grading individual devices with a margin for properly stating memory performance specifications. Operation in the third segment supports screening at elevated temperatures for identifying weak and defective memory devices.

5 Claims, 7 Drawing Sheets

INTEGRATED CIRCUIT POWER SUPPLY HAVING PIECEWISE LINEARITY

This is a continuation of application Ser. No. 08/194,184, filed on Feb. 8, 1994 now abandoned, entitled INTEGRATED CIRCUIT POWER SUPPLY HAVING PIECEWISE LINEARITY.

TECHNICAL FIELD

This invention relates to circuits for providing regulated power and to power supply circuits in integrated circuits.

BACKGROUND

As one example of an integrated circuit (IC) having a power supply circuit, consider a dynamic random access memory (DRAM) formed as an integrated circuit. Such an IC conventionally accepts an externally applied power signal ($V_{CCX}$) on one of its contacts. To operate, $V_{CCX}$ is applied with a voltage in a range including 5 volts measured relative to a ground contact. For retaining data stored in the memory while it operates, $V_{CCX}$ is supplied from a battery in a range including 3.3 volts. The reliability of such a DRAM design is commercially important. Therefore, individual DRAM ICs are tested at elevated temperatures and at elevated values of $V_{CCX}$, such as a voltage about 8 volts, to identify devices that do not conform to design specifications. These tests are called burn-in tests. Design specifications, some of which are measured during burn-in tests, are published and guaranteed by the manufacturers of DRAMs.

The circuits that make up the conventional 3.3 volt DRAM include a power supply circuit that receives $V_{CCX}$ and provides an optimal value for an internal voltage $V_{CCR}$. The value of $V_{CCR}$ cannot be obtained by measurement after the DRAM has been encapsulated. Process variation from lot to lot and from device to device in an extreme case can produce a percentage of DRAMs each having a power supply circuit wherein the transition points for the piecewise linear function of $V_{CCR}$ as a function of $V_{CCX}$ vary widely from design values. This variation limits the effectiveness of DRAM testing, especially burn-in screening for the removal of weak parts from inventory to be sold.

In addition to the lack of burn-in screening effectiveness, testing for purposes of guaranteeing operating specifications is also made difficult by conventional DRAM power supply circuitry. The conventional power supply circuit provides a regulated value for $V_{CCR}$ over a wide range of values of $V^{CCX}$. Since many operating specifications are affected by $V_{CCR}$, the fact that $V_{CCR}$ is not measurable in an encapsulated DRAM makes selection of a guaranteed specification a difficult empirical exercise. To avoid a large number of devices found to not conform to the guaranteed specification after delivery, manufacturers pad the specification to allow for process variation, testing tolerances, and temperature variation, to name a few significant variables. If on the other hand, the padded specification is too conservative, many superior devices will be sold as if they were lower grade devices and the premium price for superior devices cannot be collected.

These problems are not unique to DRAM manufacturing. Identical problems assail the manufacture of any integrated circuit type, including logic circuits, microcontrollers, microprocessors, memory devices, analog and digital converters, analog circuits, amplifiers, receivers, modulators, video circuits, and digital signal processors, to name a few representative types.

In view of the problems described above and related problems that consequently become apparent to those skilled in the applicable arts, the need remains in the manufacture of integrated circuits for an improved power supply circuit.

SUMMARY

Accordingly, an integrated circuit in one embodiment of the present invention includes a power supply circuit having a voltage source responsive to an externally applied power signal, a circuit for performing a function of the integrated circuit, and means for coupling the voltage source to the circuit so that the circuit receives an output signal of the voltage source. Operation of the voltage source is characterized by a first threshold and a second threshold.

According to a first aspect of such an integrated circuit, when the absolute value of the voltage of the power signal is below the first threshold, the output voltage is proportional to the voltage of the power signal according to a first mathematical relation. In one embodiment, the externally applied power signal is $V_{CCX}$, the output of the voltage source is $V_{CCR}$, and the mathematical relation is a constant of proportionality. Hence, $V_{CCR}$ rises linearly with $V_{CCX}$ for a range of values of $V_{CCX}$ and in one DRAM embodiment is approximately equal to $V_{CCX}$ for preserving data stored in memory.

According to another aspect, when the absolute value of the voltage of the power signal is between the first and second thresholds, the output voltage is proportional to the voltage of the power signal according to a second mathematical relation. In one embodiment, the externally applied power signal is $V_{CCX}$, the output of the voltage source is $V_{CCR}$, and the mathematical relation is a second constant of proportionality. Hence, $V_{CCR}$ rises linearly with $V_{CCX}$ for a range of values of $V_{CCX}$. In one DRAM embodiment $V_{CCR}$ increases slightly with $V_{CCX}$, but the variation is sufficient for improved operational testing, especially when measuring graded parameters for sorting devices according to performance criteria such as access time. Tests with $V_{CCX}$ slightly outside the specified range of values for $V_{CCX}$ provide test results useful for guaranteeing performance within the specified range because the value of the internal $V_{CCR}$ voltage corresponding to the value of $V_{CCX}$ is predictably at a value that pads the test results.

According to another aspect, the means for coupling the voltage source to the circuit controls power to the circuit responsive to the output signal and to the power signal. In one embodiment, when the absolute value of the voltage of the power signal is below the second threshold, the means for coupling controls power according to the output voltage. When the absolute value of the voltage of the power signal is above the second threshold, the means for coupling controls power according to the voltage of the power signal, for example by limiting the input voltage to the circuit to the voltage of the power signal. By limiting, voltage supplied to the circuit is predictably an offset from the voltage of the power signal. In one embodiment, burn-in testing is facilitated because elevated values of internal voltages are reliably obtained with an external power signal having a minimal elevated voltage.

According to an aspect of another embodiment of the present invention, the means for coupling includes a transconductance amplifier so that power to the circuit is provided from a controlled source.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

In each functional block diagram, a broad arrow symbolically represents a group of signals that together signify a binary code. For example, a group of address lines is represented by a broad arrow because a binary address is signified by the signals taken together at an instant in time. A group of signals having no binary coded relationship is shown as a single line with an arrow. A single line between functional blocks represents one or more signals.

Signals that appear on several figures and have the same mnemonic are directly or indirectly coupled together. A signal named with a mnemonic and a second signal named with the same mnemonic followed by an asterisk are related by logic inversion.

DESCRIPTION

Figure 1:
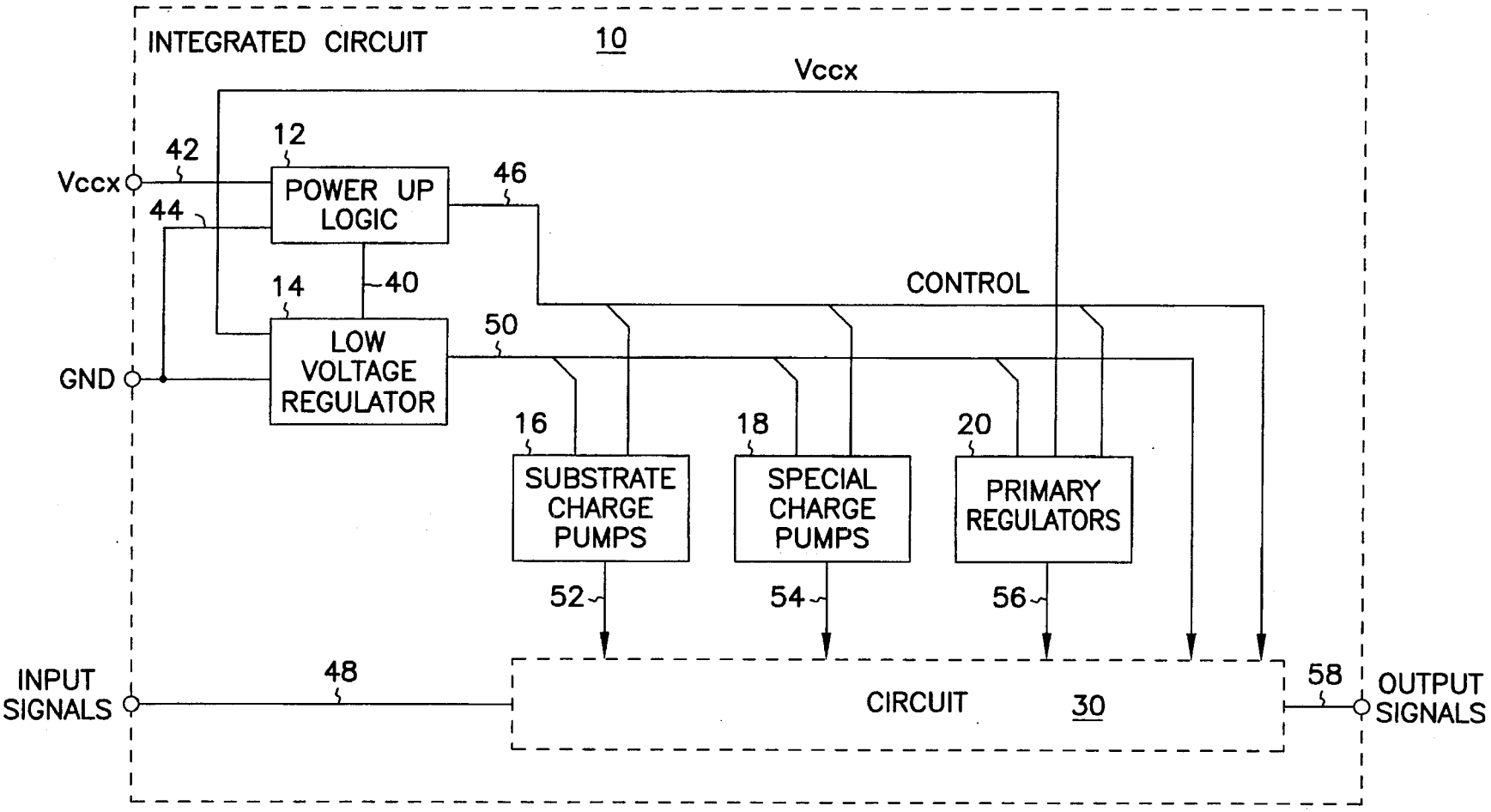
FIG. 1 is a functional block diagram of an integrated circuit of the present invention.

FIG. 1 is a functional block diagram of an integrated circuit of the present invention. Integrated circuit 10 is an integrated circuit having conventional electrical circuit functions shown generally as circuit 30, and connections for power signals 42 ($V_{CCX}$), ground conductor 44 (GND), an input shown generally as input signal 48 and an output shown generally as output signal 58. Output signal 58 is not necessary and may be deleted when the function of circuit 30 does not require provision of an output signal. As shown, circuit 30 uses power and control signals for initialization and operation.

Power signals provided to circuit 30 are derived from power signals 42. Voltages of power signals, for example $V_{CCX}$, are conventionally measured relative to a reference signal, for example GND. When circuit 30 requires multiple power signals for operation, integrated circuit 10 includes low voltage regulator 14 and primary regulators 20. Low voltage regulator 14 provides intermediate power signals 50, coupled as required to substrate charge pumps 16, special charge pumps 18, and primary regulators 20. Substrate charge pumps 16 provide power signals 52 coupled to circuit 30. Special charge pumps 18 provide power signals 54 coupled to circuit 30. Primary regulators 20 provide power signals 56 coupled to circuit 30. When circuit 30 requires fewer power signals for operation, intermediate power signals 50 may be simplified and related circuit simplifications may be employed as is well known in the art.

Low voltage regulator 14 receives power and control signals 40 provided by power up logic 12. In alternate and equivalent embodiments, regulator 14 regulates elevated voltages or currents. Control signals 40 enable and govern the operation of low voltage regulator 14. Similarly control signals 46, provided by power up logic 12 enable and govern the operation of substrate charge pumps 16, special charge pumps 18, and primary regulators 20. The sequence of enablement of these several functional blocks depends on the circuitry of each functional block and upon the power signal sequence requirements of circuit 30.

Circuit 30 is a circuit for performing an electrical function of IC 10. In various embodiments circuit 30 is an analog circuit, a digital circuit, or a combination of analog and digital circuitry. Although the present invention is effectively applied where circuit 30 includes dynamic memory (DRAM), a static memory (SRAM), or a video memory (VRAM) having a serial port, the present invention can be beneficially and equivalently applied by a person of ordinary skill to integrated circuits in general, whether or not the integrated circuit is powered from a single power supply potential.

The conventional dynamic memory includes an array of storage cells. In a memory of the present invention, accessing the array for read, write, or refresh operations is accomplished with circuitry powered by voltages having magnitudes different from the voltage magnitude of signal $V_{CCX}$. These additional voltages are developed from a voltage reference circuit to be described.

Power to be applied to circuit 30 is conventionally regulated to permit use of integrated circuit 10 in systems providing power that is insufficiently regulated otherwise for proper operation of circuit 30. Low voltage regulator 14 includes a voltage reference and regulator circuit having sufficient regulated output to supply signal $V_{CCR}$, part of power signals 50.

Figure 2:
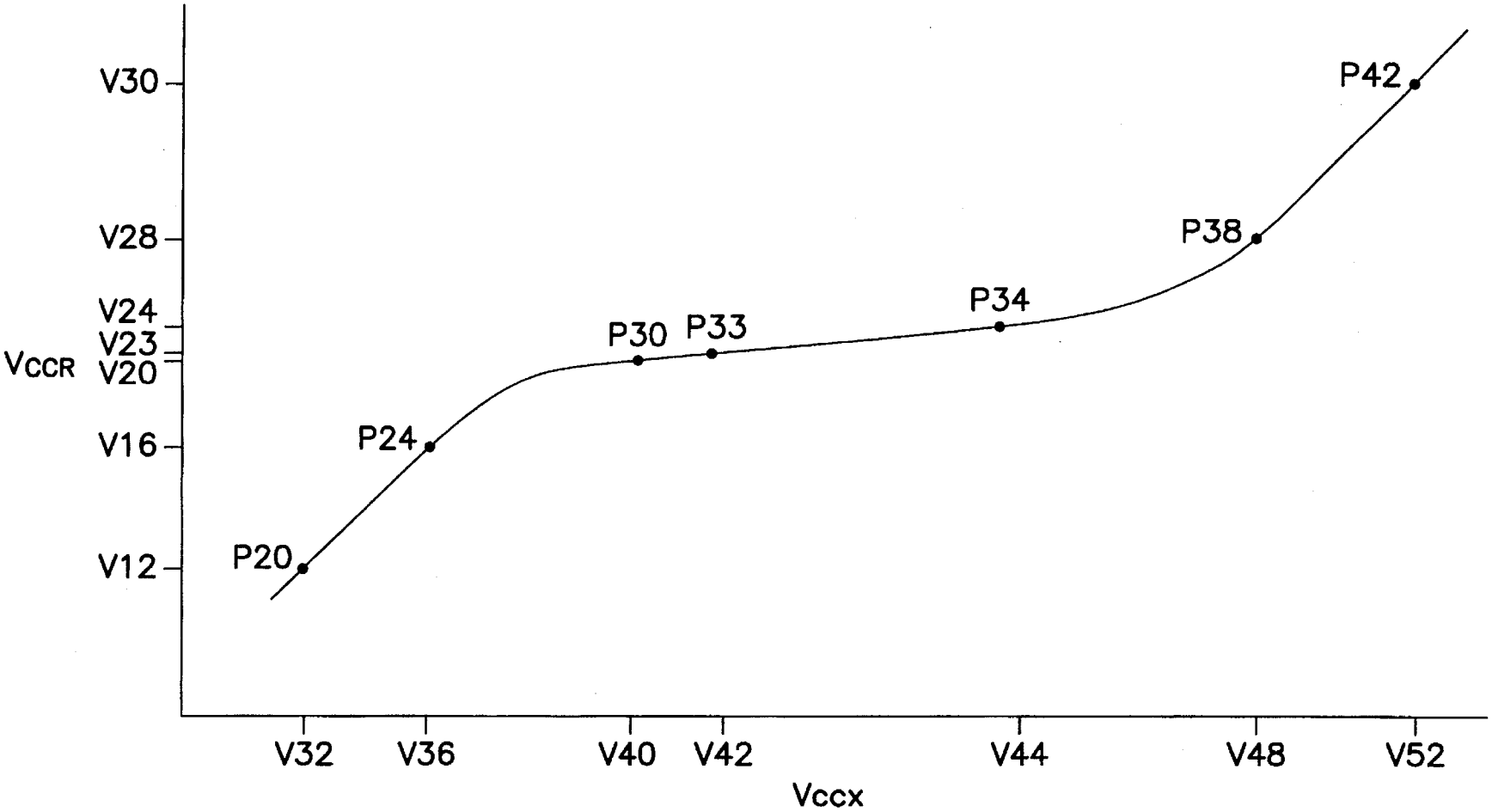
FIG. 2 is a graph of a piecewise linear relationship between $V_{CCX}$ and $V_{CCR}$.

FIG. 2 is a graph of a piecewise linear relationship between $V_{CCX}$ and $V_{CCR}$. As shown, $V_{CCR}$ is a monotonic function of $V_{CCX}$, wherein portions of the function can be approximated by linear segments having nonzero slope. The relationship between $V_{CCX}$ and $V_{CCR}$ along one of these segments is characterized by a nonzero constant. When restricted to a range of values for $V_{CCX}$, for example, the bounded range from $V_{40}$ to $V_{44}$, $V_{CCR}$ is in proportional relation to $V_{CCX}$, wherein the mathematical relation is dominated by a nonzero constant of proportionality, i.e. the slope of the segment from $P_{30}$ to $P_{34}$.

In a first segment from $P_{20}$ to $P_{24}$, $V_{CCR}$ approximates $V_{CCX}$ for efficient low voltage operations. The voltage of $V_{CCR}$ is proportional to the voltage of the power signal $V_{CCX}$ when the voltage of the power signal does not exceed a threshold voltage, $V_{36}$. In an embodiment of integrated circuit 10 that includes dynamic random access memory, operation in the first segment provides data retention at low power consumption. The slope of the first segment in such an embodiment is set to about unity, so that voltage $V_{12}$ of $V_{CCR}$ is approximately equal to voltage $V_{32}$ of $V_{CCX}$ and voltage $V_{16}$ is equal to voltage $V_{36}$.

In a second segment from $P_{30}$ to $P_{34}$, used for normal operations of the integrated circuit, $V_{CCR}$ rises gradually with $V_{CCX}$ so that test results at the edges of the segment can be guaranteed with a margin for measurement tolerance, process variation, and derating. The voltage of $V_{CCR}$ is proportional to the voltage of the power signal $V_{CCX}$ when the voltage of the power signal exceeds a threshold voltage, $V_{40}$, which is greater than $V_{36}$. In an embodiment of integrated circuit 10 that includes dynamic random access memory, operation in the second segment supports speed grading individual devices with a margin for properly stating memory performance specifications.

Conventional regulator circuitry is optimized to eliminate variation of $V_{CCR}$ over the range of voltages of $V_{CCX}$ from $V_{40}$ to $V_{44}$, i.e. a zero slope for the second segment. In the present invention, a nonzero slope is employed so that tests can be conducted at conditions known to be outside the range of voltages for $V_{CCX}$ to be specified.

As an example of the utility of a nonzero slope for the second segment, consider DRAM maximum access time specification testing. For a particular device, access time when $V_{CCX}$ corresponds to $V_{30}$ will be greater than access time when $V_{CCX}$ corresponds to $V_{33}$. By testing all devices at $V_{CCX}$ corresponding to $V_{30}$, maximum access time can be guaranteed in the range $V_{33}$ to $V_{34}$ with a margin for test tolerance variation, operating temperature variation, and similar variables and derating factors.

In a third segment from $P_{38}$ to $P_{42}$, $V_{CCR}$ follows below $V_{CCX}$ at a predetermined constant offset. The offset is defined as the voltage difference between $V_{CCX}$ and $V_{CCR}$. As shown, the offset ($V_{48}$–$V_{28}$) is equal to the offset ($V_{52}$–$V_{30}$). Operation in the third segment supports screening at elevated temperatures for identifying weak and defective memory devices.

Transitions between segments are smooth in embodiments to be discussed below, due to nonlinear devices used in the power supply circuitry. Conventional power supply circuits used in integrated circuit on-chip regulators employ switching circuits, for example, for selecting a regulator reference voltage when increasing $V_{CCX}$ from the second to the third segments. Use of a comparator and switch is avoided in the present invention to avoid a discontinuity or step in the relation between $V_{CCX}$ and $V_{CCR}$.

In a conventional relation between $V_{CCX}$ and $V_{CCR}$ that includes a step between adjacent segments, various factors make device screening and operation unreliable. For example, when a given $V_{CCX}$ value is used in test or screen, the resulting value of $V_{CCR}$ would lie within an unacceptably wide range of values due to process, temperature, and measurement tolerance variations. Performance under such conditions could not be favorable guaranteed. In a conventional relation wherein a segment is used as the operating range and an adjacent segment is used for burn-in screening, some devices could endure the screen without being operated in the third segment simply because the externally applied value for $V_{CCX}$ and particular device characteristics at the extremes of allowable ranges combine adversely. In a system that employs such a conventional IC, there is a possibility that the useful life of the IC would be shortened because the system may operate the IC in the third segment, unintentionally. System reliability in such a case would be markedly less than anticipated. These difficulties with conventional circuits are avoided in the present invention in part by the use of nonlinear devices.

Figure 3:
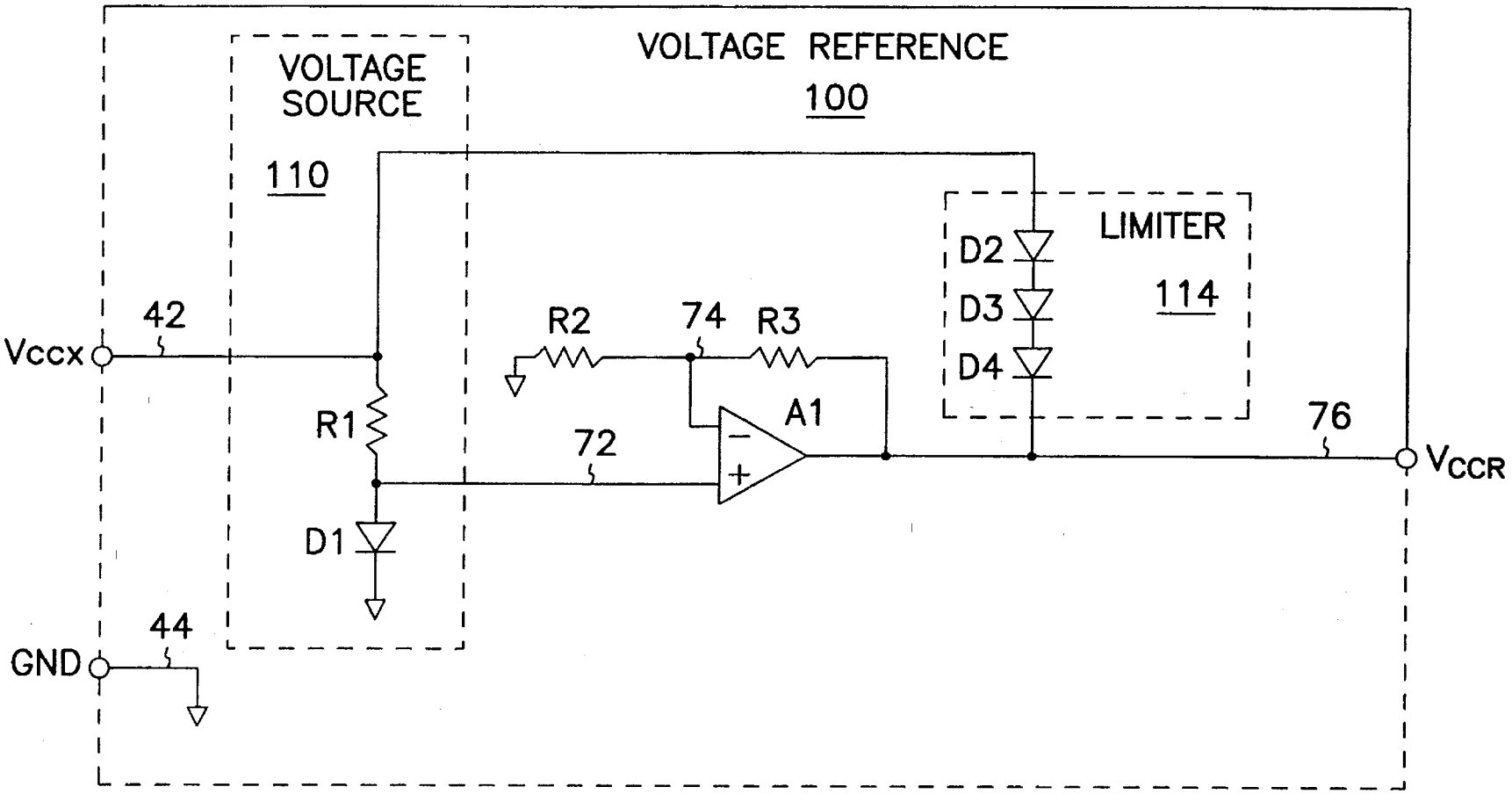
FIG. 3 is a functional block diagram of a voltage reference used in low voltage regulator 14 shown in FIG. 1.

FIG. 3 is a functional block diagram of a voltage reference used in low voltage regulator 14 shown in FIG. 1. Voltage reference 100 is powered by power signal $V_{CCX}$ and provides the voltage $V_{CCR}$ according to the piecewise linear function of $V_{CCX}$ as described with reference to FIG. 2. Voltage reference 100 includes voltage source 110, operational amplifier A1, and limiter 114. Voltage source 110 is formed as a voltage divider providing voltage $V_S$ on line 72 as a ratio of resistor R1 in combination with a nonlinear device shown as diode D1. The gain of amplifier A1 in one embodiment is about 2 as set by gain setting resistors R2 and R3. Limiter 114 is a nonlinear device shown as series coupled diodes D2, D3, and D4.

Line 72 provides means for coupling R1 and D1, thereby generating signal $V_S$. In alternate and equivalent embodiments, means for coupling includes additional resistance, capacitance, nonlinear devices, and active devices. Line 72, amplifier A1, resistors R2 and R3, and line 76 cooperate to provide means for coupling signal $V_S$ to circuit 30. Line 76 provides means for coupling limiter 114 to circuit 30, thereby generating signal $V_{CCR}$. In one embodiment line 76 connects to circuit 30 as indicated by signals 50 on FIG. 1. In alternate and equivalent embodiments, other circuitry including resistance, capacitance, nonlinear and active devices, and amplifier, regulator, buffer, chopper, limiter, and switching circuits cooperate to accomplish coupling of signals $V_S$ to circuit 30 and coupling of limiter 114 to circuit 30. In another alternate embodiment, limiter 114 is connected to line 72 and amplifier A1 has unity gain.

Signal $V_{CCR}$ in one embodiment powers circuit 30. In alternate and equivalent embodiments signal $V_{CCR}$ controls power to circuit 30 by controlling charge pump, amplifier, or regulator circuits, as indicated by signals 50 on FIG. 1.

Figure 4:
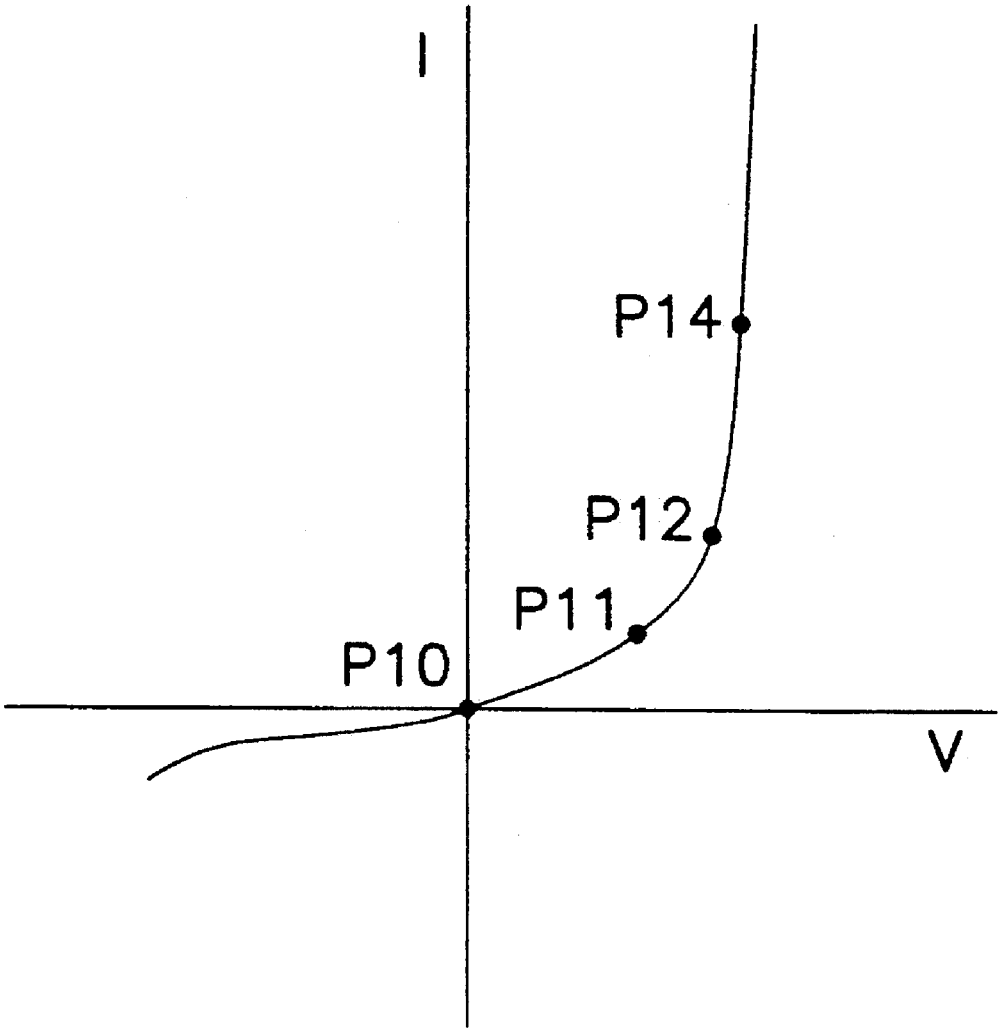
FIG. 4 is a graph of a voltage-current characteristic curve.

Operation of voltage reference 100 is best understood with reference to FIG. 4. FIG. 4 is a graph of a voltage-current characteristic curve, typical of diodes D1 through D4 shown in FIG. 3. From the vertical axis to the right, the curve shows operation while the diode is forward biased. From the vertical axis to the left, the curve shows operation while the diode is reverse biased. When the voltage of $V_{CCX}$ as applied to voltage divider 110 is between V32 and V36, the forward resistance of diode D1 is high as indicated between points P10 and P11 on FIG. 4. Voltage source 110, therefore, provides a voltage $V_S$ of about $V_{CCX}/2$. Because amplifier A1 amplifies signal $V_S$ with a gain of about 2, the resulting voltage of $V_{CCR}$ closely follows $V_{CCX}$. As the voltage of $V_{CCX}$ is increased between V36 and V40, the forward resistance of diode D1 smoothly decreases as shown between points P11 and P12 on FIG. 4. The resulting voltage of $V_{CCR}$ increases without discontinuity between the first segment, P20 to P24, and the second segment, P30 to P34.

When the voltage of $V_{CCX}$ as applied to voltage divider 110 is between V40 and V44, the forward resistance of diode D1 is low and constant for a wide range of values indicated between points P12 and P14 on FIG. 4. Resistor R1 now strongly affects the relation between $V_{CCX}$ and $V_S$. Voltage source 110, therefore, provides a voltage $V_S$ with a nonzero slope. The resulting range of voltages for $V_{CCR}$ occupy a comparatively small but significant range between V20 and V24.

As the voltage of $V_{CCX}$ is increased between V44 and V48, the forward resistance of diodes D2, D3, and D4 gradually decreases as shown between points P11 and P12 on FIG. 4. The resulting voltage offset between $V_{CCX}$ and $V_{CCR}$ smoothly decreases to a minimum corresponding to the forward voltage drop of diodes D2, D3, and D4. The smooth turn on of diodes D2, D3, and D4 assures no step or discontinuity between the second segment, P30 to P34, and the third segment, P38 to P42. Limiter 114, by operation of nonlinear devices, diodes D2, D3, and D4, provides means for controlling power to circuit 30. When the voltage of $V_{CCX}$ does not exceed threshold voltage $V_{44}$, signal $V_S$ governs power to circuit 30. When the voltage of $V_{CCX}$ exceeds voltage $V_{48}$, which is greater than voltage $V_{44}$, signal $V_{CCX}$ governs power to circuit 30.

When the voltage of $V_{CCX}$ as applied to voltage divider 110 is between V48 and V52, the forward voltage drop of diodes D2, D3, and D4 is fairly constant for a wide range of current values indicated between points P12 and P14 on FIG. 4. Therefore, the voltage offset between $V_{CCX}$ and $V_{CCR}$ remains constant and $V_{CCR}$ has a high and predictable value in the range V28 through V30.

By setting the gain of amplifier A1 together with the resistance of resistor R1 and the characteristic curve of diode D1, the slope of the first segment of the piecewise linear functional relation between $V_{CCX}$ and $V_{CCR}$ can be made near unity for optimal low voltage performance of integrated circuit 10. By setting the forward conduction characteristic of diode D1, a uniform nonzero slope can be established for the second segment. In an embodiment wherein performance is improved at higher values of applied $V_{CCX}$, performance can be specified as measured with $V_{CCX}$ of $V_{40}$, for example, and then guaranteed in the range from $V_{42}$ to $V_{44}$. The difference in voltages $V_{40}$ and $V_{42}$ has a corresponding difference in reference voltages $V_{20}$ and $V_{23}$, and thus, a corresponding difference in performance of integrated circuit 10. Due to the slope in the second segment, specifications are set with less padding, and customers are assured of higher quality ICs. By setting a low and predicable voltage offset for operation in the third segment, aggressive burn-in screening can be accomplished at lower values of $V_{CCX}$, again resulting in higher quality ICs available for shipment. Additional characteristics of the voltage reference shown in FIG. 3 are better understood from a detailed schematic diagram.

Figure 5:
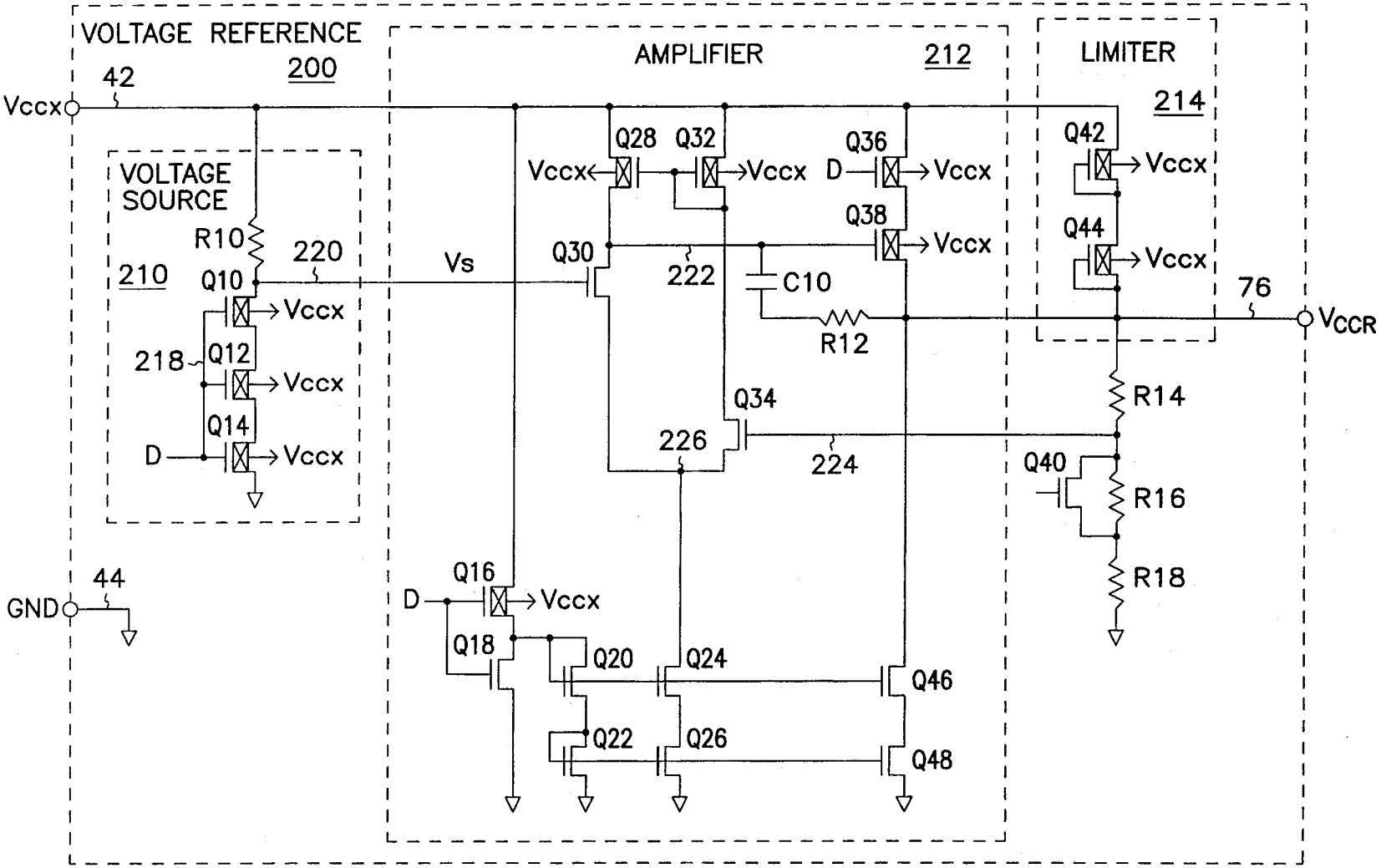
FIG. 5 is a schematic diagram of an embodiment of the voltage reference shown in FIG. 3.

FIG. 5 is a schematic diagram of an embodiment of the voltage reference shown in FIG. 3. Voltage reference 200 includes voltage source 210, amplifier 212, and limiter 214. Voltage reference 200 responds to the voltage $V_{CCX}$ on line 42, referenced to ground signal GND on line 44. Two additional signals, D and T, are used in IC fabrication and test. Signal D, shown for example at Q10, Q16, and Q36, when high disables operation of voltage reference 200 for power conservation. Signal T, shown for example at Q40, when high trims the resistance appearing between line 224 and ground. Although not shown, the substrate is pumped to about −1.3 volts.

In an alternate power supply circuit wherein $V_{CCR}$ supplies power to a substrate charge pump and the resulting substrate bias voltage is used in the voltage reference circuit, the power supply circuit may fail to properly start due to the possibility of a stable circuit state other than the desired full power state. This auxiliary stable state is characterized by insufficient substrate bias potential. This auxiliary state is avoided in the present invention by selecting P-channel transistors for the functions described for diodes D1 through D4 in FIG. 3. P-channel transistors are formed in one or more wells coupled for bias to $V_{CCX}$. By using P-channel devices, stable operating characteristics result including a back bias characteristic that is independent of $V_{CCX}$.

Voltage source 210 includes, as a nonlinear device corresponding to diode D1 in FIG. 3, the series combination of several transistors. Each transistor, Q10, Q12, and Q14 is designed for an overall characteristic curve similar to that shown in FIG. 4. In an embodiment for use in a DRAM, six P-channel transistors are series connected in the same manner as shown for transistors Q10 through Q14. The well of each transistor is connected to the highest positive voltage available, in this case $V_{CCX}$. The dependence of $V_T$ is cancelled by the temperature dependence of mobility as a result of the following six transistor geometries (length/width) given in microns: 30/0.64, 30/0.64, 30/1.28, 30/0.64, 30/0.64, 60/5.35. With $V_{CCX}$ of 3.3 volts $V_S$ is 1.65 volts, well within the input signal range of amplifier 212.

Amplifier 212 includes current mirror current sources formed from transistors Q16 through Q26, Q46 and Q48; a pair of transistors, Q30 and Q34, coupled as a difference amplifier; lines 220 and 224 as inputs; and line 222 as an output. The gain of amplifier 212 is set by feed back from the output to input line 224 with resistors R14, R16, and R18 having values in one embodiment of 105K, 68K, and 105K ohms respectively. Transistor Q38 buffers the amplifier output. Transistor Q36, when turned off by signal D, interrupts current flow through the feedback circuit. Capacitor C10 and resistor R12 damp signal changes at the output of amplifier 212. In one embodiment, C10 has a capacitance of 100 fF and R12 has a resistance of 26.4K ohms.

Limiter 214 includes two P-channel transistors Q42 and Q44. The geometry of each transistor is designed to provide a low, reliable value for $V_T$ so that, in combination, the offset voltage drop through these transistors is about 2.5 volts and independent of $V_{CCX}$, process variation, and operating temperature. In one embodiment, geometries (length/width) given in microns are: 360/0.64 and 450/0.64 respectively.

Figure 6:
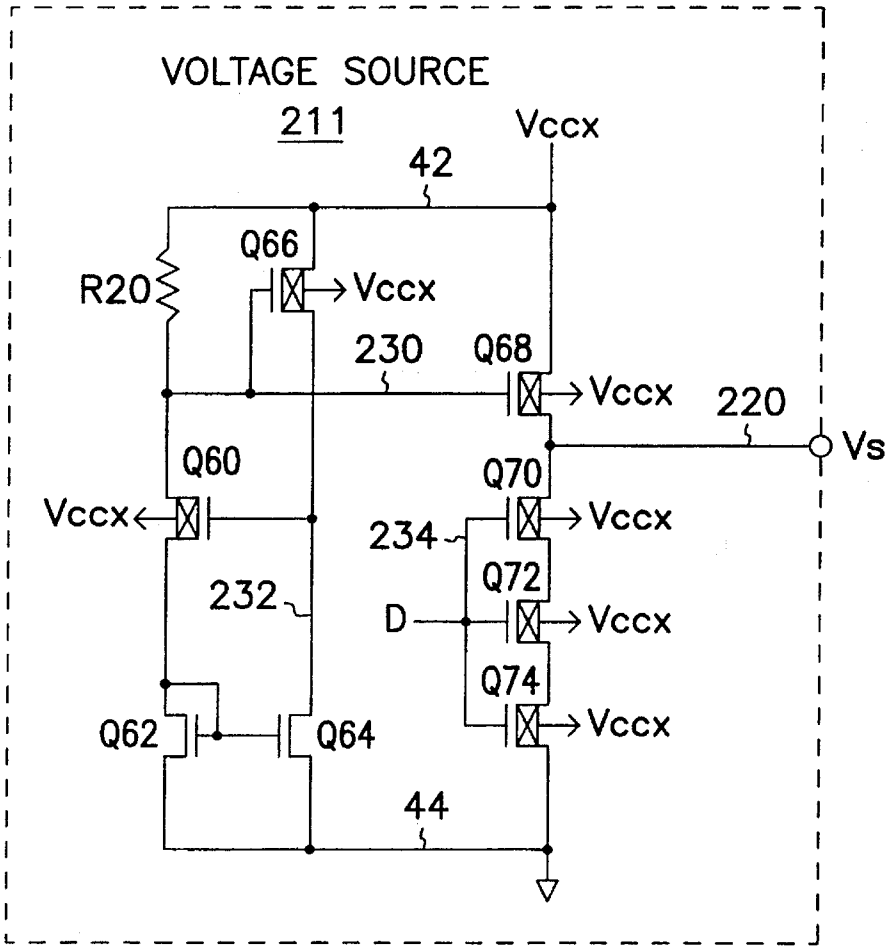
FIG. 6 is a schematic diagram of an alternate embodiment of the voltage source shown in FIG. 5.

FIG. 6 is a schematic diagram of an alternate embodiment of the voltage source shown in FIG. 5. In FIG. 5, $V_{CCX}$ and resistor R10 form an imperfect current source for setting the operating point on the characteristic curve for transistors Q10 through Q14. In an alternate embodiment of voltage reference 200, resistor R10 is replaced with a current mirror current source. The alternate voltage source 211, shown in FIG. 6, includes a current mirror circuit, a buffer transistor, and a nonlinear device. The current mirror circuit includes transistors Q60 through Q66 and resistor R20. Current flow through transistor Q66 is mirrored in buffer transistor Q68. Transistor Q70 through Q74 form the nonlinear device in a way identical to transistors Q10 through Q14 as already described with reference to FIG. 5. The voltage $V_S$ in the alternate embodiment is set to about 1.65 volts by design of the resistance of R20, the geometries of the current mirror transistors, and the geometries of the transistors forming the nonlinear device.

Figure 7:
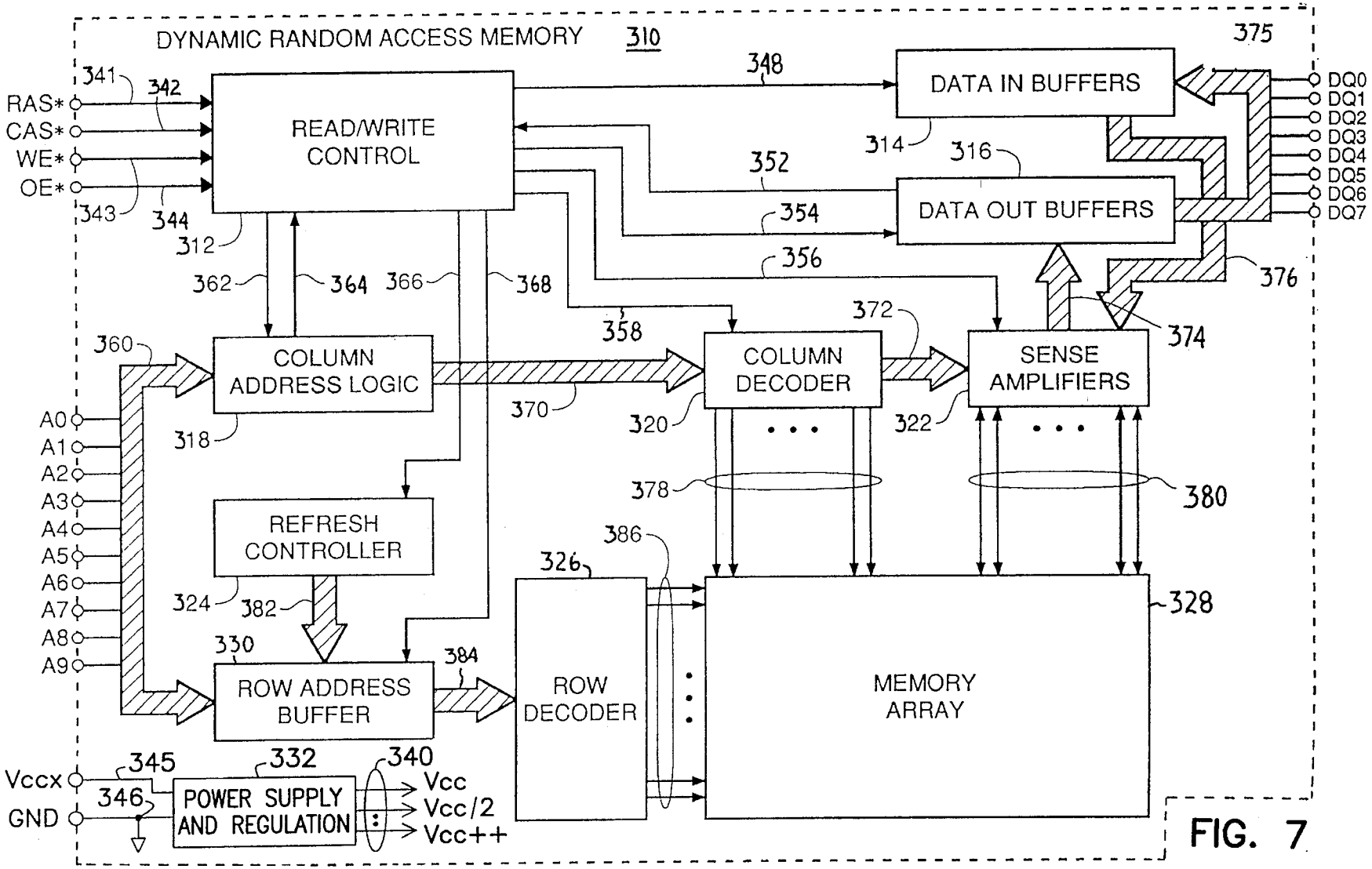
FIG. 7 is a functional block diagram of a dynamic random access memory, according to the present invention.

FIG. 7 is a functional block diagram of a dynamic random access memory according to an embodiment of the present invention. Memory 310 provides an output data signal, DQ, corresponding to data stored in the memory. Memory 310 is controlled by binary control signals input on lines 341 through 344 from the device contacts to read/write control 312. Control signals on lines 341–344 are conventionally known by names corresponding to the primary function of each signal. The primary signal on line 341 is row address strobe (RAS*); on line 342 is column address strobe (CAS*); on line 343 is write enable (WE*); and on line 344 is output enable (OE*). When RAS* falls, the state of address bus 360 is latched in row address buffer 330 in response to control signals on line 368. When CAS* falls, the state of address bus 360 is latched in column address logic 318 in response to control signals on line 362.

Several read and write modes of operation (also called cycles) are conducted by read/write control 312 in response to address change signals on line 364 and combinations of control signals on lines 341–344. For example, read/write control 312 responds to changes in the column address as indicated by address change signals on line 364 for improved access time as in page mode. Read/write control 312 generates control signals on lines 348–358 for two different write cycles. The first, early write, follows a RAS*, WE*, CAS* control signal sequence. The second, late write, follows a RAS*, CAS*, WE* control signal sequence.

When RAS* falls while CAS* is low, read/write control 312 provides signals on line 366 to refresh controller 324 to enable self refreshing. Refresh controller 324 includes a clock circuit and means for selecting a cell to refresh. During self refresh mode, refresh controller 324 generates signals on refresh row address bus 382 (for example, as generated by the output of a refresh row address counter or register clocked by an oscillator) to select a row of cells to refresh. Row address buffer 330 provides signals on row address bus 384 to row decoder 326. Signals on binary row address bus 384, in response to control signals on line 368, represents either the address latched when RAS* falls or the refresh row address, depending on the mode of operation. During a refresh cycle, data signals on lines 380 from the selected row are amplified by sense amplifiers 322 causing cells in the row to be refreshed.

In addition to cell refreshing, sense amplifiers 322 respond to control signals on line 356 and column decoder signals on line 372 to perform the memory read cycle. Signals RAS*, CAS*, WE* (high), and address signals A0 through A9 cooperate to provide a control signal for a read cycle. In read operations cell content signals on lines 380 are amplified and presented to data out buffers 316 as global I/O signals on line 374. When cell contents are to be overwritten in a write operation, sense amplifiers 322 establish proper cell contents in response to write data signals on line 376 from data-in buffers 314.

Data-in buffers 314 are instrumental for write operations. Signals RAS*, CAS*, WE* (low), OE*, and address signals A0 through A9 cooperate to provide a control signal for a write cycle. In write operations cell contents are changed to correspond to the outputs on line 376 of data-in buffers 314. Data-in buffers 314 are driven by data bus 375 which comprises several individual data lines shown as $DQ_n$.

Memory 310 has eight DQ lines, each of which is bidirectional. Alternate memory devices may have less or more DQ lines and may have separate lines for the data-in (D) function and the data-out (Q) function. In memory 310, each bidirectional line is driven by a three state circuit to represent a logic low, a logic high, or an off state. In the off state, the three state circuit connects a high impedance to the DQ line so that drive circuits external to memory 310 can drive a signal onto the DQ line for data-in buffer 314.

Power supply and regulation circuit 332 responds to power supplied to memory 310 on lines 45 ($V_{CCX}$) and 46 (GND) to provide power signals to all other memory functional blocks via power signal lines 340. In one embodiment, power supply and regulator circuit 332 includes voltage reference 100 shown in FIG. 3. Circuit 30, shown in FIG. 1 corresponds to all functional blocks shown on FIG. 7 except block 332. All functional blocks shown on FIG. 1 except block 30 are included in power supply and regulator circuit 332. Power signals 340 include internal $V_{CC}$, used generally to power functional blocks of memory 310; $V_{CC/2}$ used generally for precharging circuitry that normally attains one of two binary voltage levels symmetric in magnitude about $V_{CC/2}$; and $V_{CC+}$ used generally booted signals for writing data into memory array 328. By employing one power supply as described in FIGS. 3 and 4, in power supply and regulation circuit 332, power signals 340 track each other to reduce race conditions, improve testability, and improve reliability.

In an equivalent dynamic memory, not shown, storage cells are arranged in a ring rather than in a row-column array as shown in FIG. 7. In such an arrangement, control and address signals different from those shown in FIG. 7 comprise the control signals for a read and a write operation. Storage ring architectures include magnetic bubble and charge coupled devices as is well known in the art.

In another equivalent memory, not shown, memory 310 additionally includes serial access means coupled to sense amplifiers 322 for providing serial access between the memory array and a serial input/output buffer circuit. In such a memory, control signals 356 include a transfer signal for enabling data transfer between array 328 and the serial access means.

The foregoing description discusses preferred embodiments of the present invention, which may be changed or modified without departing from the scope of the present invention.

For example, P-channel FETs may be replaced with N-channel FETs (and vice versa) in some applications with appropriate polarity changes in controlling signals as required. Moreover, the P-channel and N-channel FETs discussed above generally represent active devices which may be replaced with bipolar or other technology active devices.

Still further, those skilled in the art will understand that the nonlinear devices described above may be formed using a wide variety of semiconductor techniques including junctions, formation of layers, doping, and the like. As an example, a nonlinear device in one embodiment is a diode, in another a FET connected as a diode, and in still another a junction of a bipolar transistor. The junction of the diode, FET, or bipolar transistor in one embodiment is formed by doping, in another embodiment is formed by deposition, and in another embodiment is grown.

These and other changes and modifications are intended to be included within the scope of the present invention.

While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent in light of the disclosure to one of ordinary skill in the art to which the invention applies.

The words and phrases used in the claims are intended to be broadly construed. An "integrated circuit" refers generally to integrated electrical apparatus formed on a substrate and includes but is not limited to a packaged integrated circuit, an unpackaged integrated circuit, a combination of packaged or unpackaged integrated circuits or both, flip chip technology, a microprocessor, a microcontroller, a digital signal processor, a memory, a register, a flip-flop, a charge-coupled device, an amplifier, a modulator, a regulator, a display, combinations thereof, and equivalents.

A "signal" refers to mechanical and/or electromagnetic energy conveying information. When elements are coupled, a signal can be conveyed in any manner feasible in light of the nature of the coupling. For example, if several electrical conductors couple two elements, then the relevant signal comprises the energy on one, some, or all conductors at a given time or time period. When a physical property of a signal has a quantitative measure and the property is used by design to control or communicate information, then the signal is said to be characterized by having a "value." The amplitude may be instantaneous or an average. For a binary (digital) signal, the two characteristic values are called logic levels, "high" and "low."

When the absolute value of a signal value is greater than the absolute value of a threshold value, the signal is said to "exceed" the threshold value.

A nonlinear device includes for example a device having voltage dependent conductivity such as bulk semiconductor material, a diode, a transistor channel, or a junction. A resistor includes any device exhibiting resistance including nonlinear resistance such as voltage, temperature, or current dependant resistance.

What is claimed is:

1. An integrated memory circuit comprising:

memory support circuitry; and a power supply circuit comprising, a voltage divider circuit having a resistor connected between a voltage supply and a first node of a first diode circuit, the first diode circuit having a second node connected to a reference potential, an amplifier having a first input connected to the first node and having an output node connected to the memory support circuitry;

a feedback resistor connected between the output node and a second input of the amplifier, and a second diode circuit connected between the output node and the voltage supply.

2. The integrated memory circuit of claim 1 wherein the amplifier has a gain of about two.

3. The integrated memory circuit of claim 1 wherein the support circuitry includes a charge pump circuit connected to the output node.

4. An integrated memory circuit comprising:

memory support circuitry; and a power supply circuit comprising, a voltage divider circuit having a current mirror circuit connected to a gate of a buffer transistor, and a first diode circuit via the buffer transistor, the buffer transistor having a drain connected to a voltage supply and a source connected to a first node of the first diode circuit, the first diode circuit having a second node connected to a reference potential, an amplifier having a first input connected to the first node and having an output node connected to the memory support circuitry;

a feedback resistor connected between the output node and a second input of the amplifier, and a second diode circuit connected between the output node and the voltage supply.

5. The integrated memory circuit of claim 4 wherein the current mirror circuit comprises:

first and second transistors, the first transistor having its source connected to ground, and its gate and drain electrically connected, the second transistor having its source connected to ground and its gate connected to the gate of the first transistor;

a resistor connected between the voltage supply and a gate of a third transistor, the third transistor having a source connected to the supply voltage and a drain connected to a drain of the second transistor; and a fourth transistor having its gate connected to the drain of the third transistor, its drain connected to the drain of the first transistor, and its source connected to both the gate of the third transistor and the gate of the buffer circuit.

* * * * *